United States Patent [19]

Rogahn

[11] 4,184,284

[45] Jan. 22, 1980

[54] BUBBLE PRODUCING FLYING TOY

[76] Inventor: Dino J. Rogahn, #5 5330 N. 18th St., Phoenix, Ariz. 85016

[21] Appl. No.: 910,610

[22] Filed: May 30, 1978

[51] Int. Cl.[2] ..... A63H 33/28

[52] U.S. Cl. ..... 46/8; 46/74 D

[58] Field of Search ..... 46/6–8, 46/74 D; 40/406–408

[56] References Cited

U.S. PATENT DOCUMENTS

| | | | |
|---|---|---|---|
| 2,882,643 | 4/1959 | Jianas et al. | 46/6 |
| 3,002,314 | 10/1961 | Brottman | 46/6 |
| 3,008,263 | 11/1961 | Ellman | 46/7 |
| 3,600,842 | 8/1971 | Bryman | 46/6 |
| 3,745,693 | 7/1973 | LaFata et al. | 46/7 |

*Primary Examiner*—Charles E. Phillips

*Attorney, Agent, or Firm*—Don J. Flickinger

[57] ABSTRACT

A plate like member, having a plurality of apertures therethrough, carries a reservoir having a removal closure member with a lifting rotor. Bubble forming solution is held in the reservoir. The device is propelled into rotating flight. During flight, the rotor lifts the closure member from the reservoir, freeing the solution which is distributed by centrifugal force as a film on the upper surface of the plate like member and over the apertures. Bubbles are produced in response to air passing through the apertures and the film of bubble producing solution.

9 Claims, 7 Drawing Figures

BUBBLE PRODUCING FLYING TOY

This invention relates to toys and amusement devices.

In a further aspect, the present invention relates to flying toys that are propelled into soaring free flight.

More particularly, the instant invention concerns a rotating toy which produces bubbles during flight.

It is well known that children of all ages, youth and adults, are amused by animated toys. Particularly fascinating are model airplanes, model rockets and other toys which move through the air in flight. Generally, flying toys are usually propelled during flight by an on-board power source or projected into free flight by an external power source.

Toys which are projected into free flight assume various configurations. Commonly known are simulated gliders with wings, simulated gyroplanes with whirling rotors and saucer type devices which rotate during flight. Such toys normally fly in a trajectory, rising to an apogee then descending. Numerous mechanical means, including windlasses, explosive devices and elastic members are employed to launch the toys into flight. Flying toys are also catapulted manually.

Considerable effort has been expended to enhance the attractiveness and amusement value of free flight toys. Model rockets, for example, are commonly provided with parachutes which deploy for descent shortly after apogee. Preset control surfaces impart maneuvered flight to model gliders. Colorful decorations upon rotating toys create optical illusions during flight. Certain fast moving toys include wind activated sound generators.

Children are also fascinated by toys which dispense a visible stream during movement. For example, model rockets and model locomotives are made to emit smoke, real or simulated. Bubbles are generated by tops and by toys which are whipped about at the end of a string.

A search was conducted within the United States Patent & Trademark Office to determine prior art toys which produced bubbles during movement. The search was especially directed to a saucer type toy having a plate like body which is projected into free flight by an external source. The search revealed the following issued United States Patents:

| | |
|---|---|
| Brosseit, M. A. | 2,409,471 |
| Dawson, Stanford | 3,959,917 |
| Ellman, J. | 3,008,263 |
| Gray, W. J. | 2,556,756 |
| La Fata, et al. | 3,745,693 |
| Wolf, Tobin | 3,775,899 |

also discovered was Canadian Pat. No. 696,574 issued to Hammer.

Several of the foregoing references were directed to bubble blowing devices having no relationship to flying toys. U.S. Pat. Nos. 3,008,263 and 3,745,693 concern bubble producing toys that are whipped about at the end of a string. U.S. Pat. No. 3,745,693 teaches the construction of a toy having a container from which extends a hollow stem. As the toy is whipped about through the air at the end of a string, bubble producing liquid passes from the container to the hollow stem. Bubbles are produced in response to air passing through openings in the hollow stem. U.S. Pat. No. 3,008,263 discloses a flying toy in the form of a simulated airplane. The toy includes a propeller which rotates in response to travel through the air. The rotating propeller drives a ring which alternately passes through a resevoir of bubble solution and a position exposed to the air stream.

U.S. Pat. No. 2,409,471 illustrates a non-flying airplane toy. Tubes extending from the toy are dipped into a bubble solution. Subsequently, in response to pressure applied to the body of the aircraft, bubbles are formed at the ends of the tubes simulating the dropping of spherical bombs.

The search serves to illustrate the current state of the art concerning animated bubble producing toys. However, not found among the search was a free flight bubble producing toy.

Accordingly, it is an object of the present invention to provide an improved flying toy.

Another object of the invention is the provision of an improved flying toy of the saucer type, which rotates during flight.

Still another object of the invention is to provide an improved saucer type toy which is projected into free flight by an external source.

And another object of the invention is the provision of a free flight toy which produces a visible stream during flight.

Yet another object of this invention is to provide a toy which dispenses a substantially continuous profusion of bubbles during flight.

Yet still another object of the invention is the provision of a flying toy in which bubbles are produced in response to relative air movement generated during flight.

A further object of the present invention is to provide a toy of the above-character, having a reservoir for holding bubble forming solution during free flight, and from which the solution is released during and as a result of flight.

A further object of the invention is the provision of a relatively simple bubble producing free flying toy which does not require extraneous skills to operate.

Yet a further object of the invention is the provision of a flying toy having enhanced amusement value.

And yet a further object of the instant invention is to provide a toy which is comparatively durable and relatively inexpensive to manufacture.

Briefly, to achieve the desired objects of the instant invention, in accordance with a preferred embodiment thereof, provided is a substantially rigid plate like body having an aperture therethrough. The aperture includes an open end at the top surface of the body. A reservoir carried by the body holds a quantity of bubble forming solution. The toy is projected into rotating free flight by a force supplied from a source separate from the toy. Means are provided for releasing the bubble forming solution from the reservoir during flight. Centrifugal force distributes the solution as a film over the upper end of the aperture and in response to air passing through the aperture, a bubble is produced.

In accordance with a further embodiment, the reservoir includes a closure member which is lifted, during flight, by a rotor. The reservoir may be in the form of a cylindrical projection and the closure member, the form of a correspondingly sized inverted cup like member. The reservoir is formed between the projection and the cup like member. The body, flat or alternately domed, may include a plurality of apertures.

The foregoing and further and more specific objects and advantages of the present invention will become readily apparent to those skilled in the art from the following detailed description of preferred embodiments thereof, taken in conjunction with the drawings in which.

Figure 1:
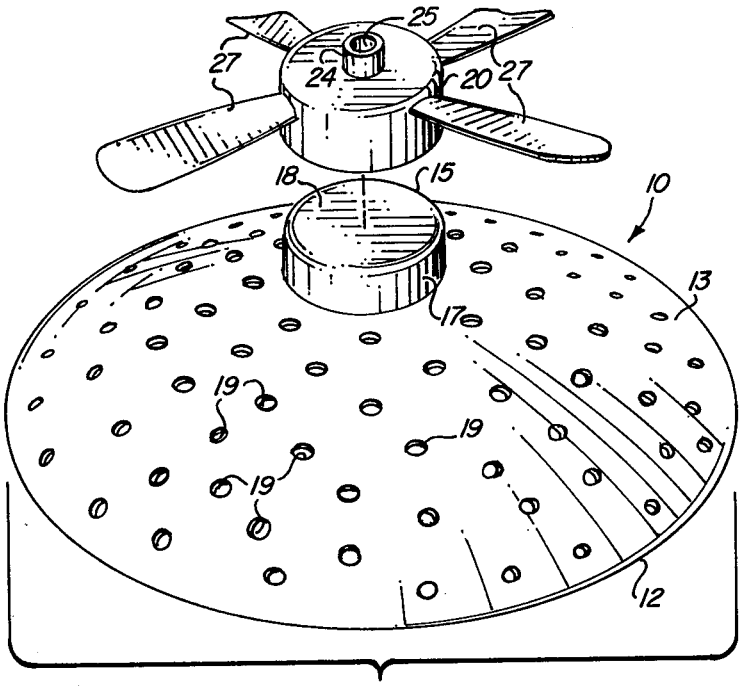
FIG. 1 is an exploded upper perspective view, partly broken away, of a bubble producing flying toy, constructed in accordance with the teachings of the instant invention.

Turning now to the drawings, in which like reference characters indicate corresponding elements throughout the several views, attention is first directed to FIG. 1, which shows an embodiment of the instant invention having a plate like body, generally designated by the reference character 10. Body 10 is substantially rigid, being able to maintain shape during normal handling and flight. It is preferred that body 10 is also sufficiently flexible to absorb and dissipate energy resulting from crashes into stationary objects without permanent distortion or damage to the toy or the object. Various energy absorbing and high impact plastics, such as polypropylene, which are commercially available and readily occur to those skilled in the art. It is envisioned that body 10 may be fabricated of other materials including light weight metals such as aluminum.

Figure 4:
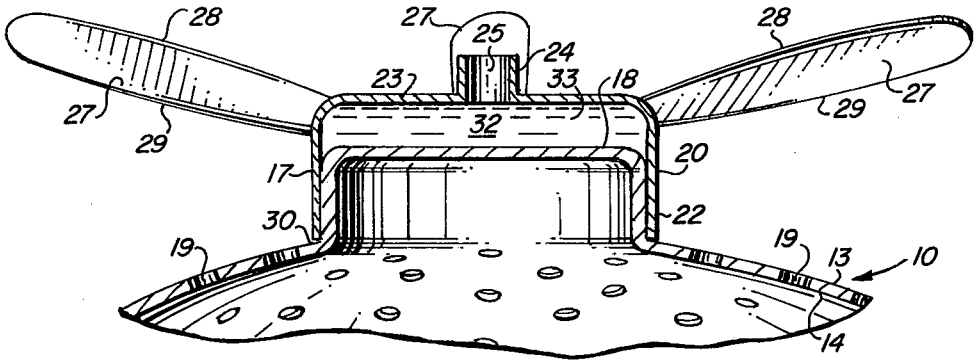
FIG. 4 is an enlarged partial vertical sectional view taken along the line 44 of FIG. 2.

Body 10 has an outer peripheral edge 12, top surface 13 and bottom surface 14, the latter viewed in FIG. 4. A projection 15, having generally upright cylindrical sidewall 17, and top 18, extends upwardly from top surface 13, proximate the center of body 10. Preferrably, body 10 and projection 15 are integrally molded. A plurality of apertures 19, extend through body 10 intermediate projection 15 and outer peripheral edge 12. In accordance with the immediate embodiment, body 10 is generally cylindrical and generally domed shaped. If, for desirable characteristics of rotation and extended flight. Other configurations will be discussed presently.

Figure 3:
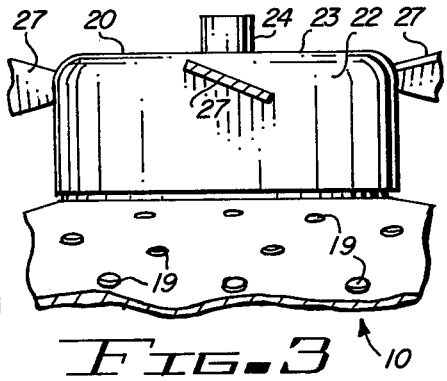
FIG. 3 is an enlarged partial vertical sectional view taken along the line 33 of FIG. 2.
Figure 2:
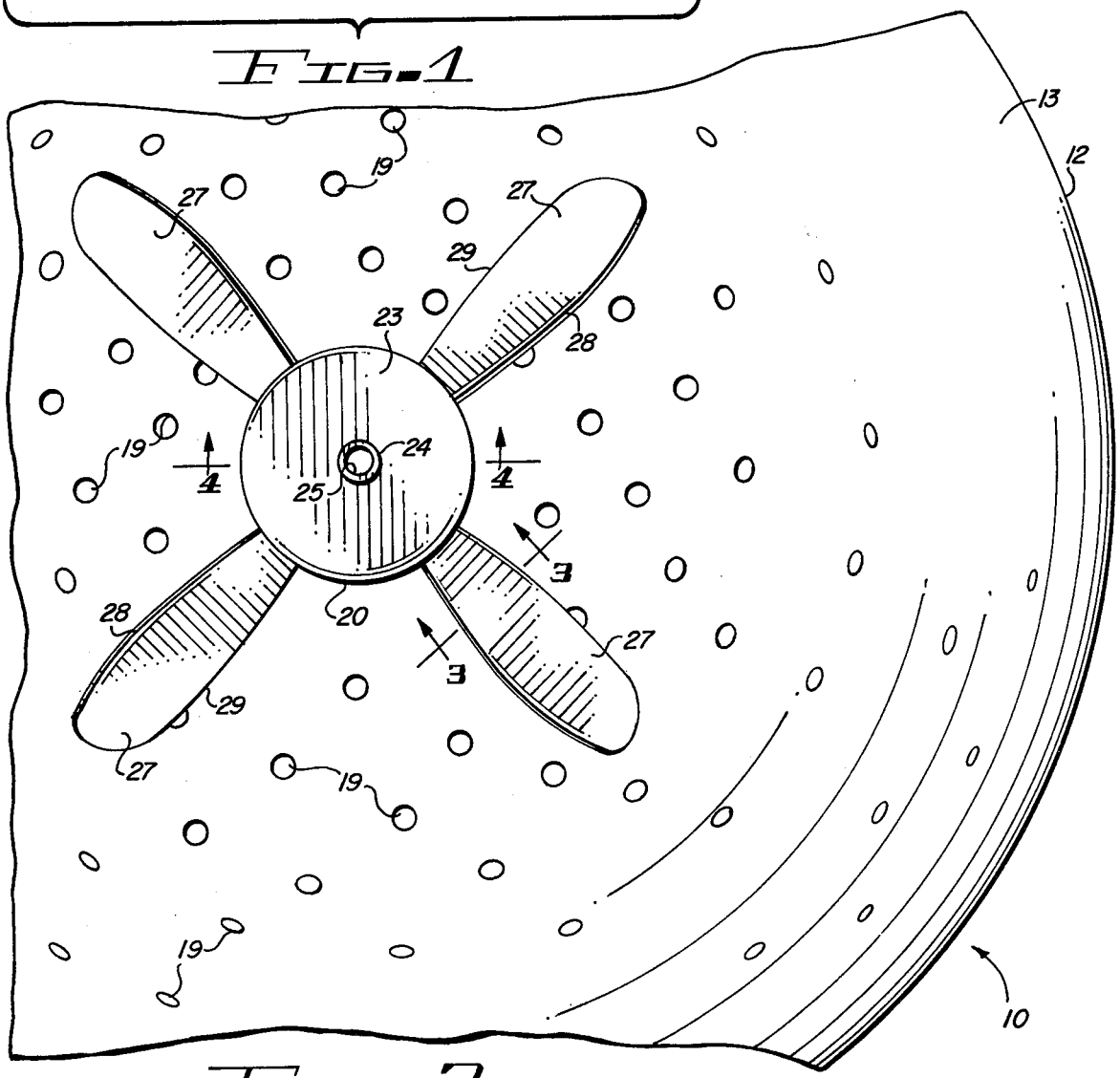
FIG. 2 is an enlarged top plan view, partly broken away, of the toy of FIG. 1.

Referring also to FIGS. 2 and 3, there is seen an inverted cup like member 20, having a generally cylindrical upright sidewall 22, and a top 23. Nipple 24, extends upwardly from top 23 of cup like member 20. Opening 25, extends through nipple 24 and top 23.

Blades 27, each having a leading edge 28 and a trailing edge 29, are equiangularly spaced and extend radially from cup shaped member 20. The several blades 27, taken together, comprise a rotor in terms consistent with aeronautical practice. A pitch is imparted to each blade 27, such that leading edge 28 is directed upwardly from trailing edge 29.

Sidewall 22, of cup like member 20, as specifically seen in FIG. 4, is sized to loosely receive sidewall 17 of projection 15. Top 23 of cup like member 20 is spaced above top 18 of projection 15, which spacing is created by the abutment of lower edge 30 of sidewall 22, against top surface 13 of body 10. The space between top 18 and top 23, creates reservoir 32, which holds bubble forming solution 33, entered into cavity 32, through opening 25. A quantity of solution 33, may be drawn into the space between sidewalls 17 and 22 in response to capillary action, however, since commercially available bubble forming solutions are substantially viscous, the liquid will not freely flow from resevoir 32.

The toy of the instant invention is intended to be launched into free flight by a rotating force applied to the toy from a source separate from the toy. Specifically, the force may be manual and imparted in a manner analogous to that familiarly employed with other rotating free flight toys.

Briefly, a common practice is to grasp the toy proximate an edge in the right hand and crook the right arm at the elbow, bringing the toy close to the user's chest. Subsequently, the user whips the toy outwardly from the body, straightening the arm and releasing the toy at the approximate time the arm is extended. Accordingly, a rotating free flight in a clockwise direction is imparted to the toy. Flight of the toy is described as substantially horizontal, even though the leading edge is normally tilted slightly upward. The toy also flies in a trajectory, rising to an apogee and then descending.

Figure 5:
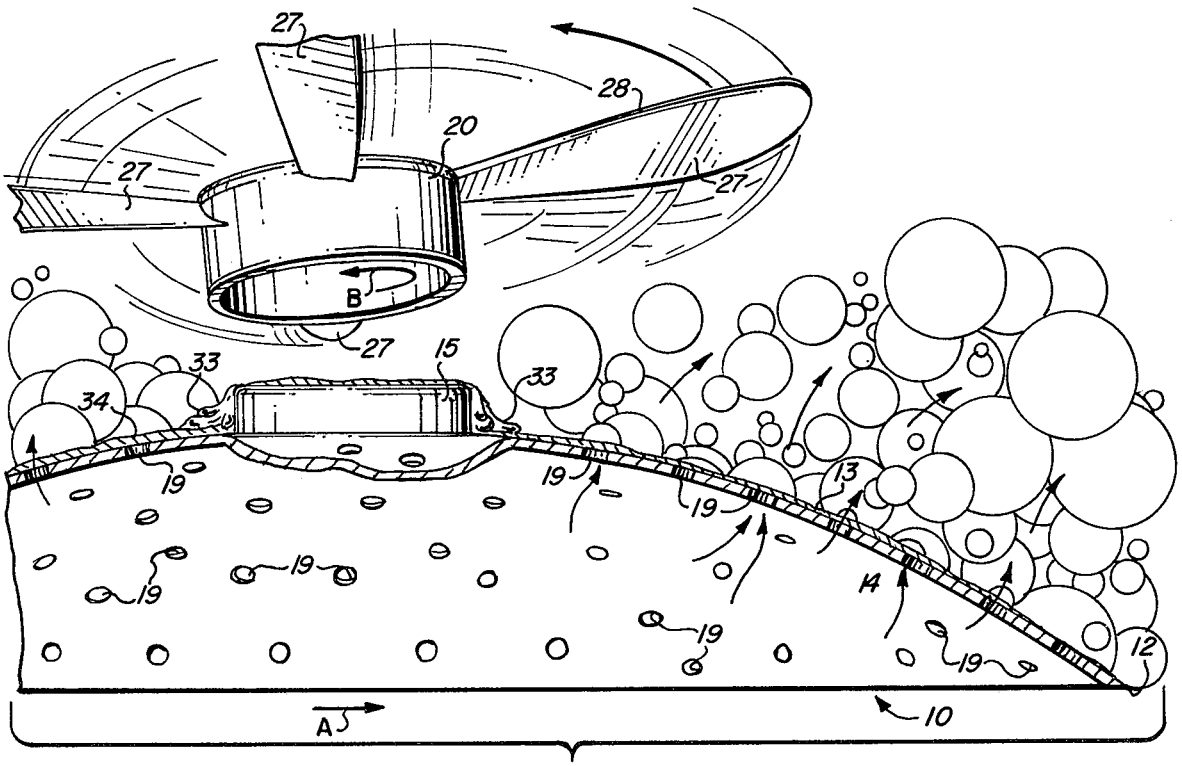
FIG. 5 is an enlarged elevational view, partly in section and partly broken away, of the device of FIG. 1 as it would appear during flight.

The following description of the operation of a flying toy of the foregoing type, set forth with reference to FIG. 5, is based upon observation of a prototype model, constructed in accordance with the teachings of the instant invention. Prior to flight, cup like member 20 was assembled with projection 15 and a quantity of bubble forming solution entered through opening 25, into reservoir 32. The device was manually launched in to free flight in accordance with the method set forth above. The clockwise direction of rotation is indicated by arrowed lines A and B. Within a few feet after leaving the user's hand, cup like member 20 lifted and separated from body 10. Body 10, being relatively heavy and lacking lifting airfoil, entered into a relatively flat sailing trajectory, rotating in the direction of arrow A. Cup like member 20, being relatively light and having lifting rotor blades 27, rose steeply upward, rotating in the direction of arrow B.

The movement of bubble forming solution 33 was unobservable. It is believed however, that bubble forming solution 33 acted as a lubricant between sidewall 17 of projection 15 and sidewall 22 of cup like member 20, thereby assisting in the separation of cup like member 20 from body 10. Apparently, bubble forming solution 33, in response to centrifugal force, spread quickly over upper surface 13 of body 10. After approximately a dozen feet of flight, bubbles began to rise from surface 13, indicating that solution 33 passed, as a film, over the end 34 of aperture 19, adjacent to surface 13. And further indicating that air passed through apertures 19. Bubbles continued to rise for the duration of the flight, which was approximately forty feet in length.

The test model had a substantially flat body. It is believed that the dome shaped body, as illustrated in the drawings, will improve flight characteristics and the movement of air through the several apertures. The length of the flight is obviously variable in accordance with the force imparted during launching. It is also obvious that the blades may be fabricated with a reversed pitch for left-handed users. In accordance with a preferred embodiment of the invention, blades 27 are fashioned from relatively thin metal, such as aluminum, and are readily bent to the desired pitch by the user.

Therefore, a single model may be alternately launched by right-handed and left-handed users.

Figure 6:
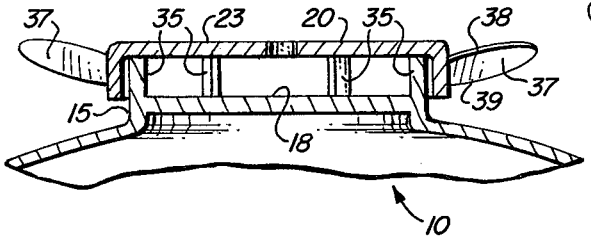
FIG. 6 is a view generally corresponding to the view of FIG. 4 and showing an alternate embodiment thereof.

FIG. 6 shows an alternate embodiment of the invention, wherein a plurality of legs 35 extend upwardly from projection 15. Top 23 of cup like member 20 rests upon the upper end of legs 35 for maintenance of spacing with top 18 and projection 15 for the creation of reservoir 32. Blades 37 having leading edge 38 and trailing edge 39, while being generally analogous to blades 27, are shorter and wider.

Figure 7:
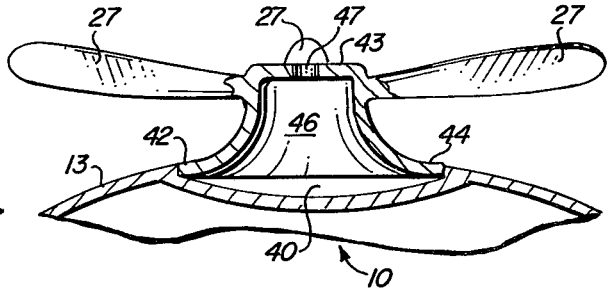
FIG. 7 is a view generally corresponding to the view of FIG. 6 and showing an alternate embodiment of the instant invention.

FIG. 7 shows yet another alternate embodiment of the invention, in which a semi-spherical depression 40 is formed in upper surface 13 of body 10 proximate the center thereof. An annular ledge 42 extends around depression 40. Closure member 43 is generally cup shaped and inverted, the lower edge 44 of which is received in annular ledge 42. Cup like member 43 and depression 40 create reservoir 46 therebetween. Bubble forming solution is entered in to reservoir 46 through opening 47 in cup shape member 43. Blades 27, as previously described, extend from cup shaped member 43.

Other aspects and function of the alternate embodiments of FIGS. 6 and 7 are consistent with the embodiment previously described in connection with FIGS. 1–5. Other changes and modifications to the embodiments, herein chosen for purposes of illustration will readily occur to those skilled in the art. To the extent that such modifications and variations do not depart from the spirit of the invention, they are intended to be included within the scope thereof, which is limited only by a fair interpretation of the appended claims.

Having fully described and disclosed the instant invention and alternately preferred embodiments thereof in such clear and concise terms as to enable those skilled in the art to understand and practice the same, the invention claimed is:

I claim:

1. A flying toy which is caused to rotate during flight by a rotating force applied to the toy from a source separate from the toy prior to flight and which produces bubbles from a bubble forming solution during flight, said toy comprising:

(a) a substantially rigid plate like body having a top surface;

(b) an aperture extending through said body and having an open end at the top surface of said body;

(c) a reservoir carried by said body for holding a quantity of said bubble forming solution; and (d) means for releasing said bubble forming solution from said reservoir during flight, whereby said solution is distributed over the upper end of said aperture in response to rotation of said toy.

2. The flying toy of claim 1, wherein said reservoir is normally closed and is opened in response to said means for releasing said solution.

3. The flying toy of claim 2, wherein:

(a) said reservoir includes a closure member; and (b) said means for releasing said solution includes a lifting member carried by said closure member for raising said closure member from said reservoir in response to rotation of said toy.

4. The flying toy of claim 1, including:

(a) a projection extending upwardly from the top surface of said body;

(b) an inverted cup like member removably enclosing said projection, said reservoir being formed between said projection and said cup like member; and (c) means for lifting said cup like member from said projection in response to rotation of said toy.

5. The toy of claim 1, including:

(a) a projection upstanding from the top surface of body and including, i. a generally cylindrical upright sidewall, and ii. a top;

(b) an inverted cup like member including, i. a generally cylindrical upright sidewall removably encircling the sidewall of said projection, and ii. a top spaced above the top of said projection and forming said reservoir therebetween; and (c) means for lifting said cup like member from said projection in response to rotation of said toy.

6. The toy of claim 4 or 5, wherein said means for lifting said cup like member includes a rotor.

7. The toy of claim 5, further including an opening through said cup like member for introducing said solution into said reservoir.

8. The toy of claim 1, further including a plurality of angularly and radially spaced apertures extending through said plate like member, each said aperture having an open upper end at the top surface of said body.

9. The toy of claim 1, wherein said body is generally dome shaped.

* * * * *